United States Patent [19]

Hodson

[11] 4,262,606

[45] Apr. 21, 1981

[54] CONVERTIBLE FOLDING TABLES

[76] Inventor: Hollis C. Hodson, P.O. Box 114, Amo, Ind. 46103

[21] Appl. No.: 635

[22] Filed: Jan. 2, 1979

[51] Int. Cl.[3] ..... A47B 57/00; A47B 3/00

[52] U.S. Cl. ..... 108/99; 108/6; 108/111; 108/118; 248/164; 248/432

[58] Field of Search ..... 108/4, 11-13, 108/15, 17, 27, 28, 32, 62, 99, 100, 101, 114, 116, 118, 6; 211/200; 248/164, 432, 188.6, 188.9; 273/287, 285, 284, 283

[56] References Cited

U.S. PATENT DOCUMENTS

| | | | |
|---|---|---|---|
| 352,555 | 11/1886 | Merkel | 108/62 |
| 445,159 | 1/1891 | Bresnan | 108/118 |
| 659,508 | 10/1900 | Collins | 108/118 |
| 747,822 | 12/1903 | Wilson | 108/118 X |
| 1,289,247 | 12/1918 | Pamperin | 248/164 UX |
| 1,494,692 | 5/1924 | Lohlker | 248/188.9 X |
| 1,806,084 | 5/1931 | Roe | 248/188.9 |
| 1,833,177 | 11/1931 | Rice | 108/118 X |
| 1,906,865 | 5/1933 | Knox | 108/62 |
| 2,418,514 | 4/1947 | Lamberson | 108/27 X |
| 2,467,900 | 4/1949 | Maine | 248/164 UX |
| 2,716,582 | 8/1955 | Rosenfeld | 108/118 X |
| 2,936,896 | 5/1960 | Friedman | 108/11 X |
| 3,365,072 | 1/1968 | Hill | 108/116 X |
| 3,489,409 | 1/1970 | Porath et al. | 108/28 X |
| 3,633,519 | 1/1972 | Nichol | 108/159 X |
| 3,685,824 | 8/1972 | Quinn | 248/164 X |
| 4,015,778 | 4/1977 | Chen et al. | 273/285 X |
| 4,138,952 | 2/1979 | Hodson | 108/116 |

FOREIGN PATENT DOCUMENTS

| | | | |
|---|---|---|---|
| 1009613 | 6/1952 | France | 108/62 |
| 245828 | 1/1926 | United Kingdom | 108/11 |
| 676607 | 7/1952 | United Kingdom | 108/62 |

*Primary Examiner*—James T. McCall

[57] ABSTRACT

A convertible, foldable stand and portable tray combination is designed to yield a maximum of utility. The stand is built of identical frames assembled in link relationship, the legs having slip-grip feet which are restrained in lateral spread by flexible reins. The stand features a removable footrest and removable braces. Portable trays, having invertible surfaces, handles, rails, and locks, feature open corners which act to facilitate many conversion arrangements on and off the stand. Tray conversions are described for obtaining vertical suspension, surface compartments, game boards, a collapsible tray system, aperture boards, side to side and edge to edge connections, bedroom lapboard, and, on the stand, many table combinations of level, slope, and level plus slope. One or more trays store between upper frame sections of the folded-up stand.

11 Claims, 25 Drawing Figures

CONVERTIBLE FOLDING TABLES

CROSS-REFERENCES TO RELATED APPLICATIONS

This application refers to application #805,403 filed June 10, 1977 by this applicant now U.S. Pat. No. 4,138,952.

BACKGROUND OF THE INVENTION

This invention relates to the collapsible table which combines a foldable stand and a portable tray.

There are innumerable collapsible table combinations wherein a foldable, cross-legged stand supports a portable tray, in general employing a single level table elevation for a single or limited purpose. Some tables have limited means for conversion to an alternate elevation, a sloped surface, an alternate structural alignment, or something in combination of these alterations. However, the convertible features of such tables as are found in the marketplace are nevertheless limited and usually specific in purpose. It is this narrow range of utility which seems to have been quite unappreciated in the art and which the applicant is hereby attempting to open up to a considerable degree.

SUMMARY OF THE INVENTION

In a collapsible table wherein a foldable cross-legged stand supports a portable tray, the improved convertible table according to the present invention is characterized by:

1. a stand assembled of two identical frames in link relationship, the sides of which frames are pivotally connected at midpoints to serve as reversible and interchangeable legs, each end of each leg having a slip-grip foot configuration, the top and bottom of which frames are removable and interchangeable rungs, usable as tray supports, the leg sets of which frames are restrained in lateral spread by flexible reins;
2. a removable footrest spanning leg sets between pivots;
3. removable diagonal braces, one per each frame;
4. invertible tray(s) having two-way surfaces, handles, rails, and locks, which trays feature open tray-bed corners, which corners enable picture-frame suspension. interconnection of trays side by side, or edge to edge into rigid or flexible prism postures, and which trays are further capable of being comparted horizontally or vertically, or being made to incorporate aperture board for use in diverse ways as such;
5. trays made into unitary game board surfaces, and into divisible surfaces for collapsed storage and travel;
6. further addition of rungs to the stand and a plurality of trays, which trays are then supportable upon the stand in innumerable combinations of levels, slopes, and levelslope arrangements; and
7. multiple trays storable inside a folded-up stand.

The object of the invention is to provide a collapsible table system out of inexpensive materials which table system can be relied upon to perform a multitude of duties by simple manipulation of the trays.

Improvements over and above structural conversions include:

1. standard mill procedures;
2. generous tolerances;
3. easy access to elemental materials;
4. no-waste dimensioning for raw materials;

5. built-in salvage design on raw elements;
6. reversible, interchangeable elements;
7. strength and stability without bulk or weight;
8. light and compact packaging for shipment;
9. dimensioning for easy metric conversion;
10. easy-to-clean trays;
11. small space requirements; and
12. uses for the stand independently.

FIGS. *7a* to *7d* are fragmentary views of four basic open corners applicable to portable trays.

Figures 4, 5, 6, 7A, 7B, 7C, 7D, 8:
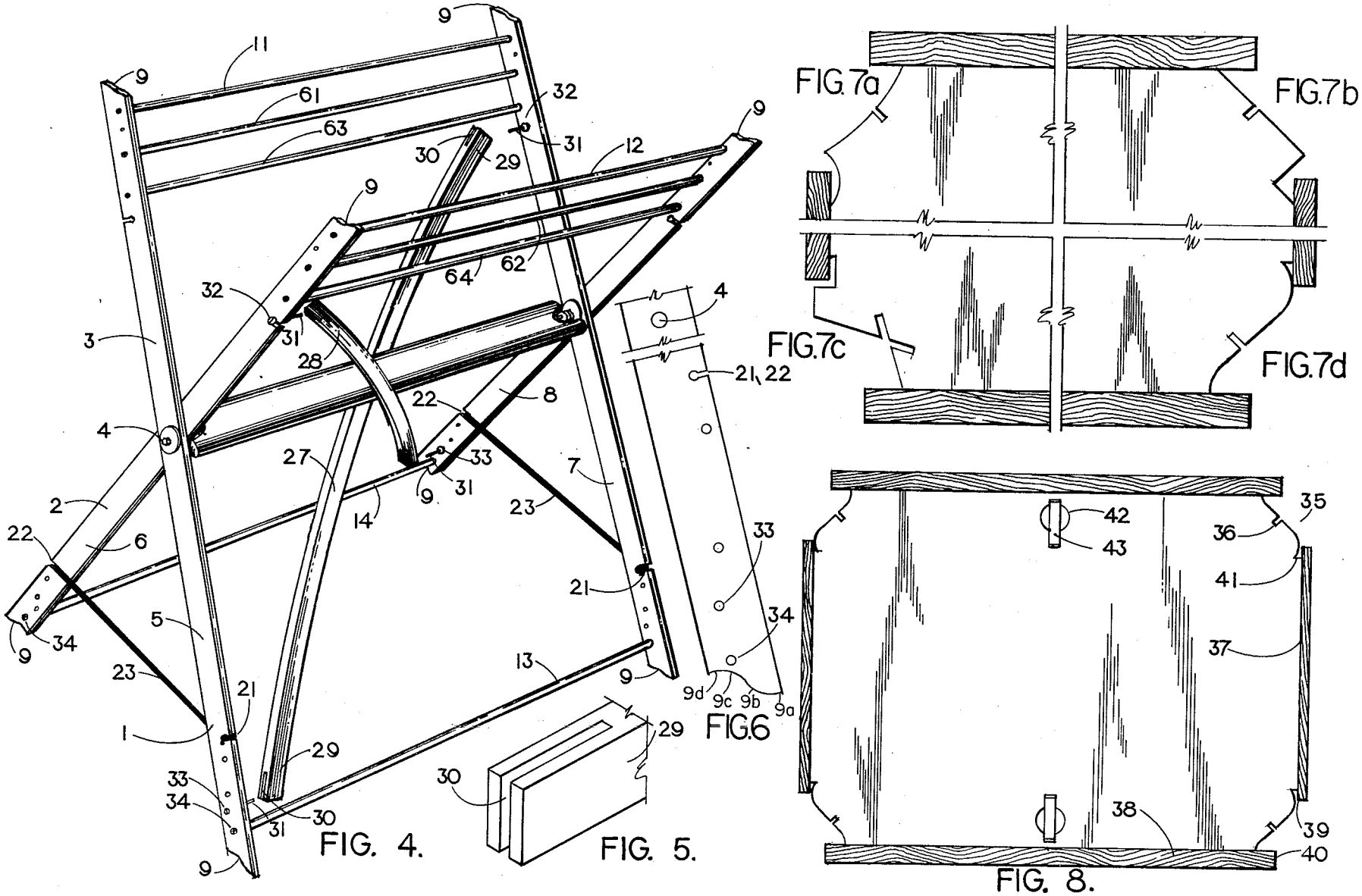
FIG. 4 is a projected view illustrating the means for removably attaching a brace to each frame of the stand.
FIG. 5 illustrates the end of a brace in larger view.
FIG. 6 shows foot parts and relative hole positions along each half-leg.

FIG. 8 illustrates the preferred embodiment of a tray.

Figure 9:
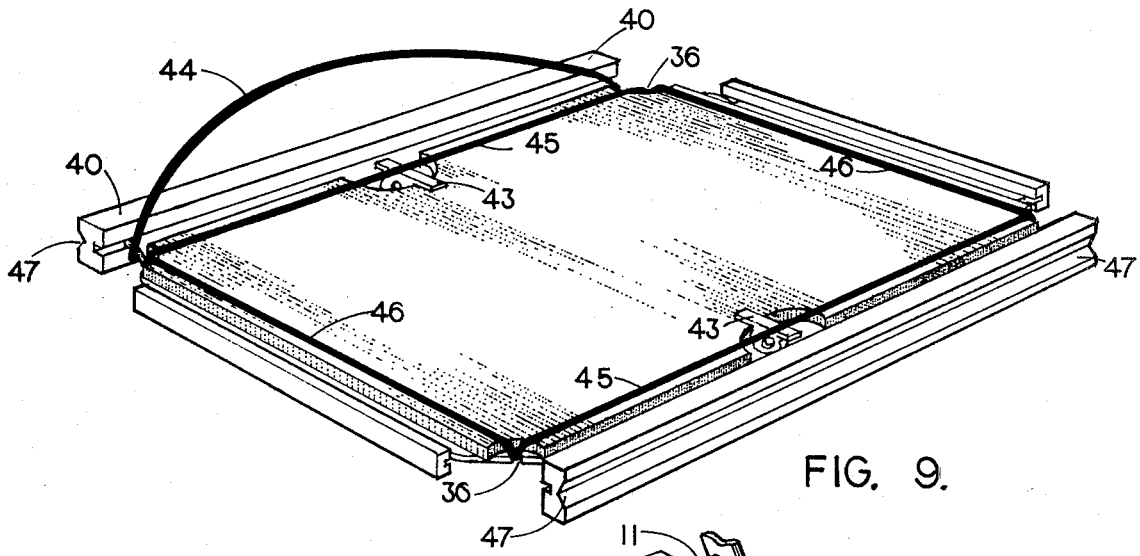

FIG. 9 shows a tray in picture-frame posture and further illustrates support of an insert.

Figure 10:
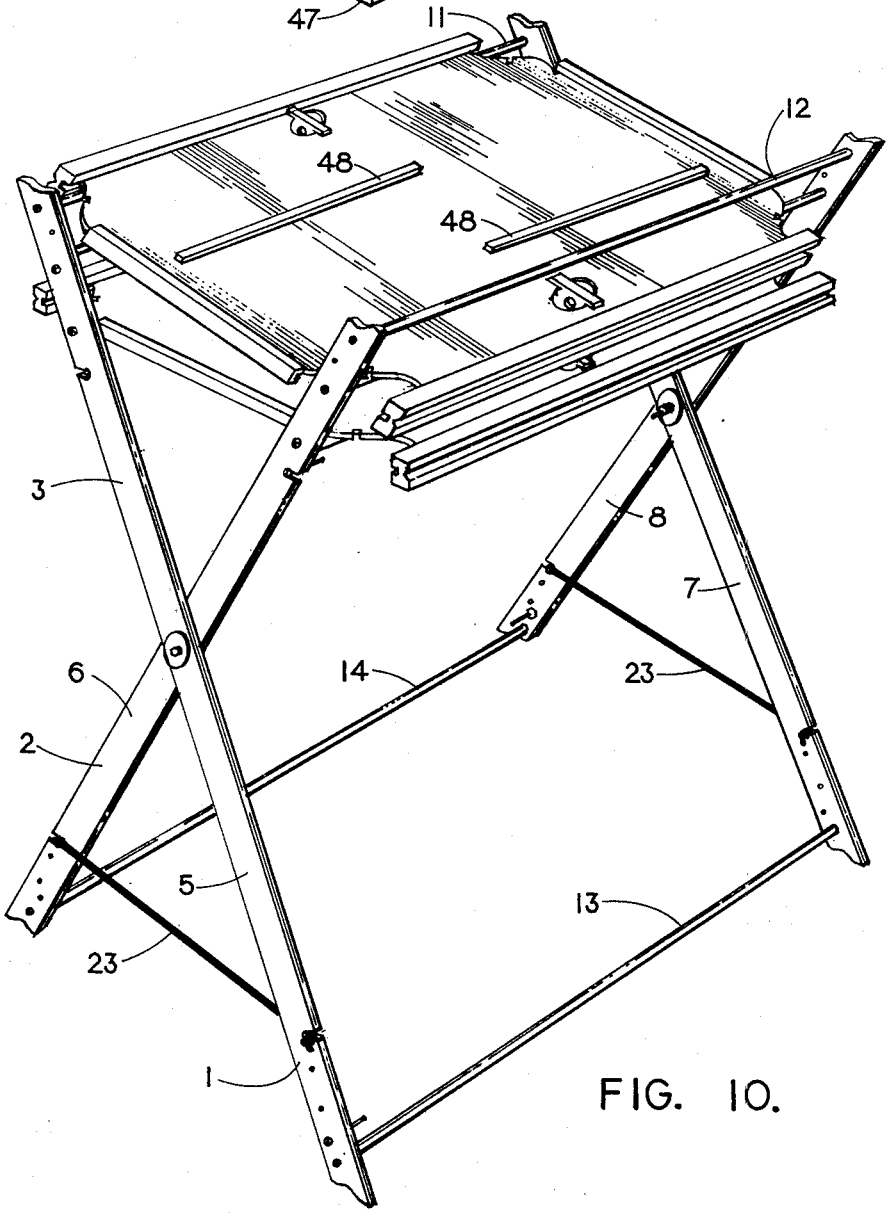

FIG. 10 illustrates use of horizontal dividers on a sloped tray surface, and additionally shows plural trays in combined slope and level relationship.

Figure 11:
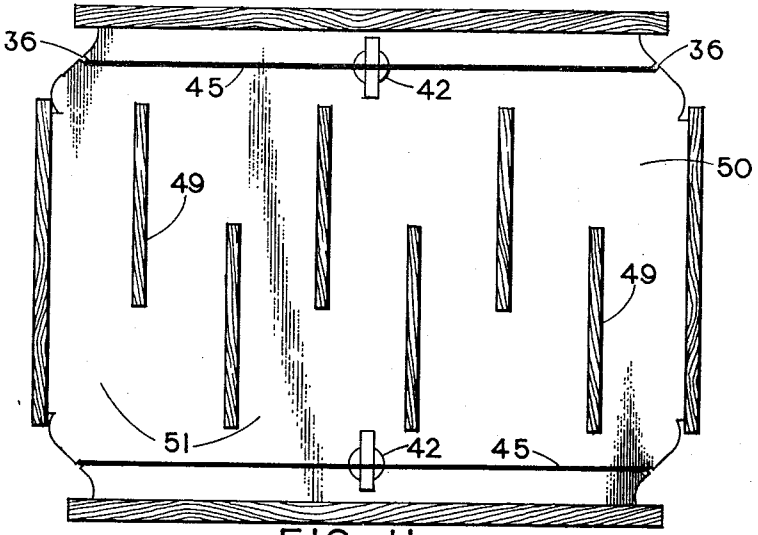

FIG. 11 illustrates use of vertical dividers on a tray.

Figure 12:
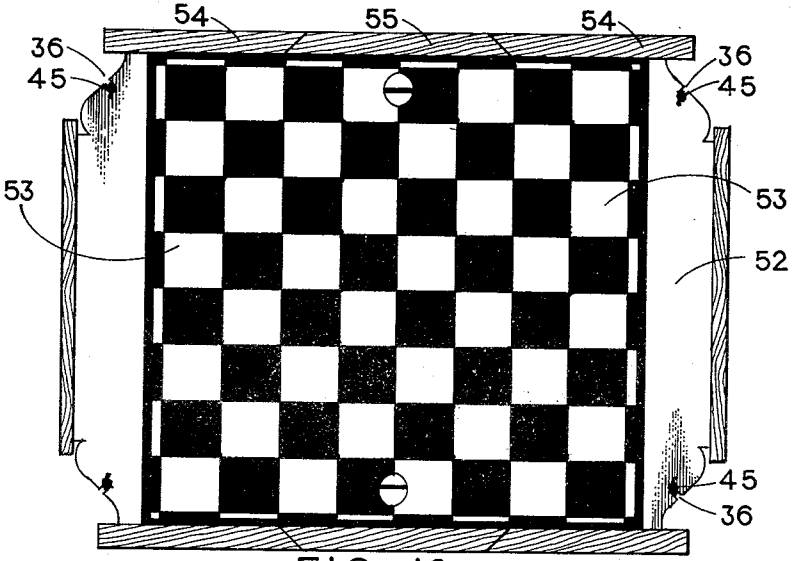

FIG. 12 shows a collapsible tray in locked-open posture.

Figure 13:
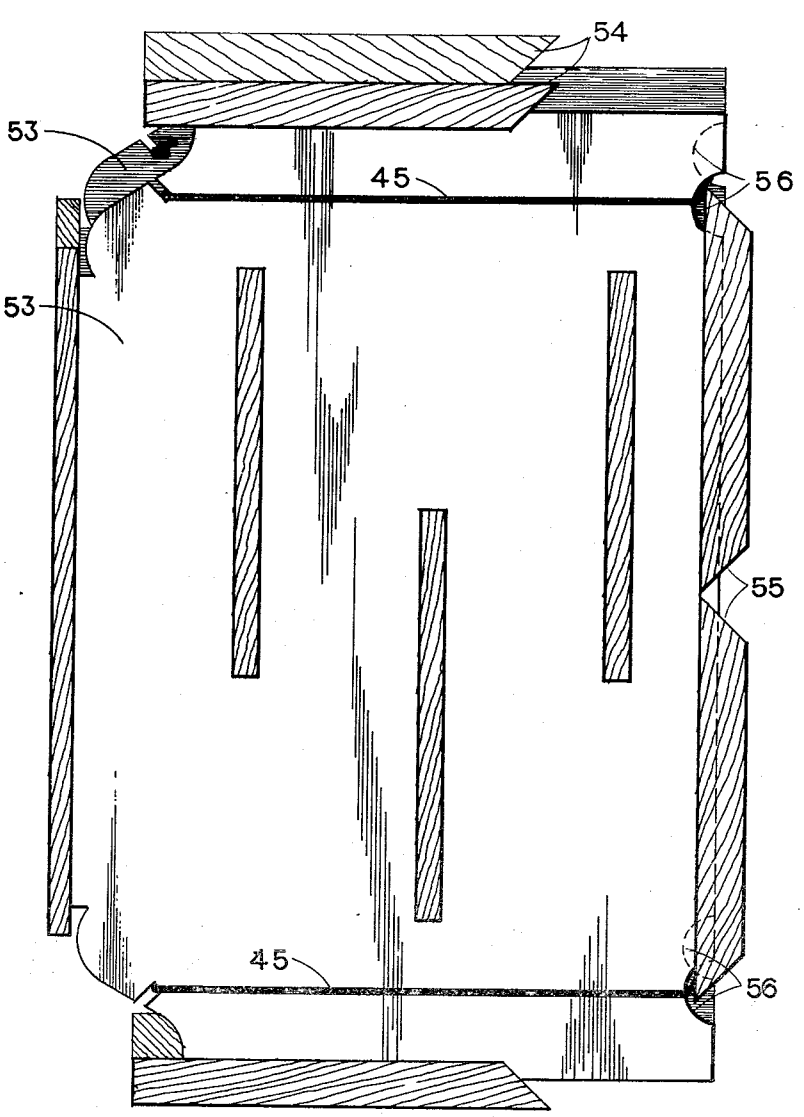

FIG. 13 shows a collapsible tray in stable folded posture.

Figure 14:
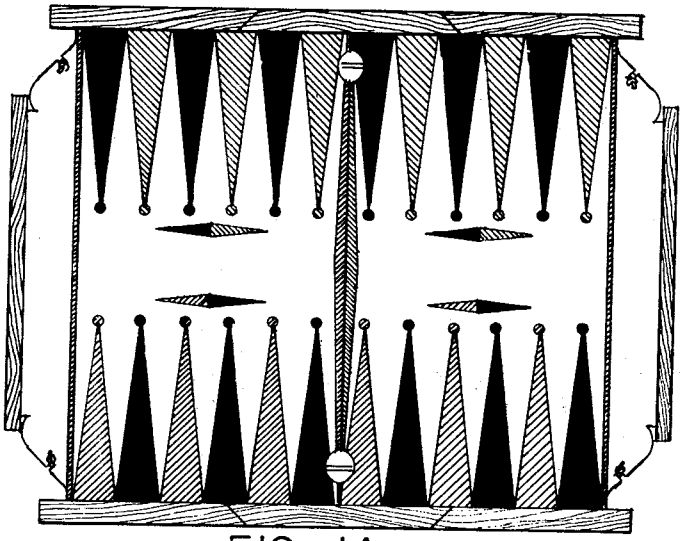

FIG. 14 illustrates a backgammon game board as a tray.

Figure 15:
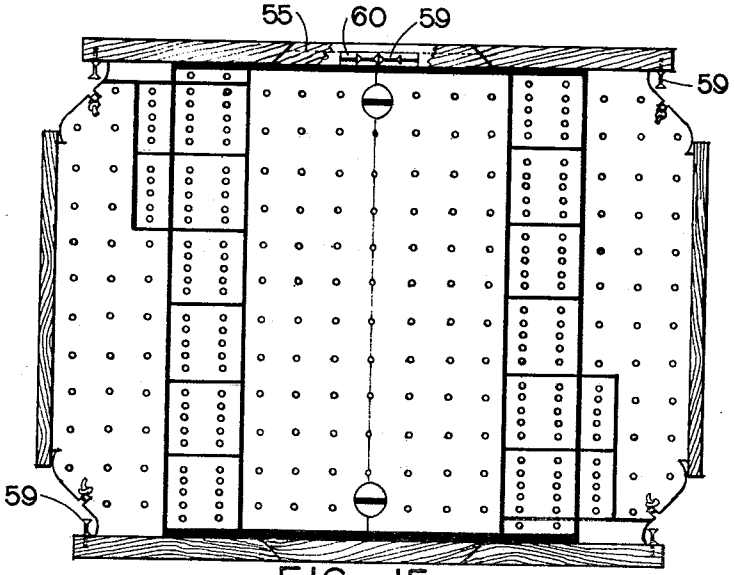

FIG. 15 illustarates a cribbage board and counters as prepared upon an aperture board tray-bed.

Figure 16:
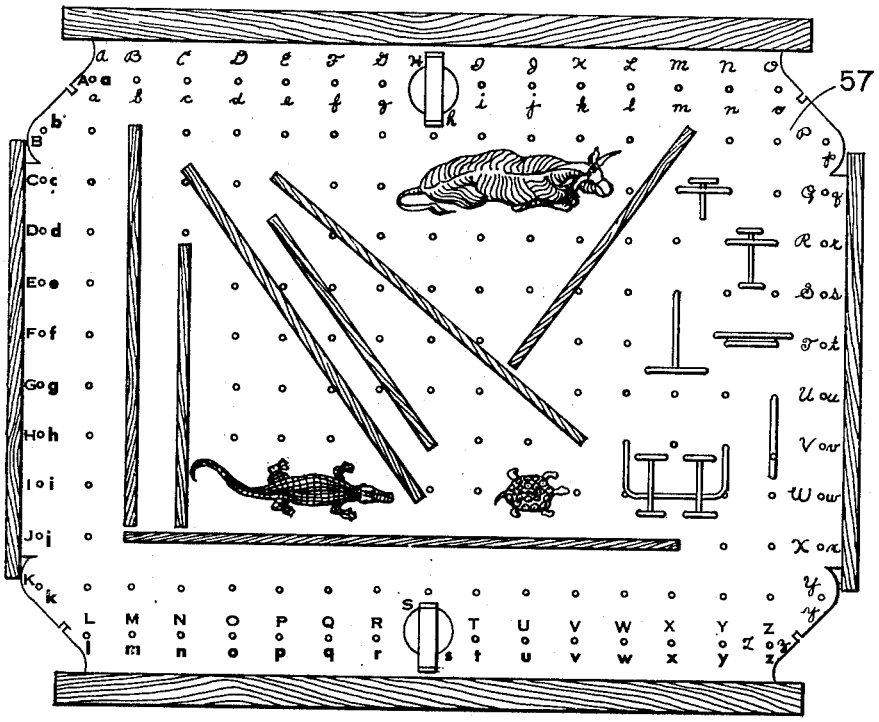

FIG. 16 shows typical uses of a tray made of aperture board.

Figure 17:
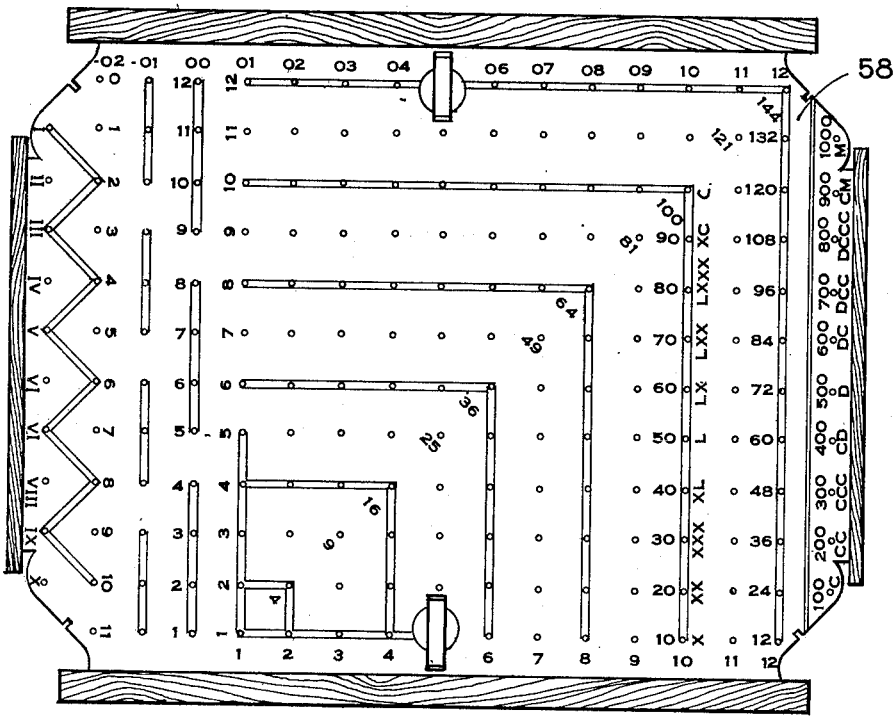

FIG. 17 illustrates an aperture board tray selectively adapted for instructional use.

Figure 18:
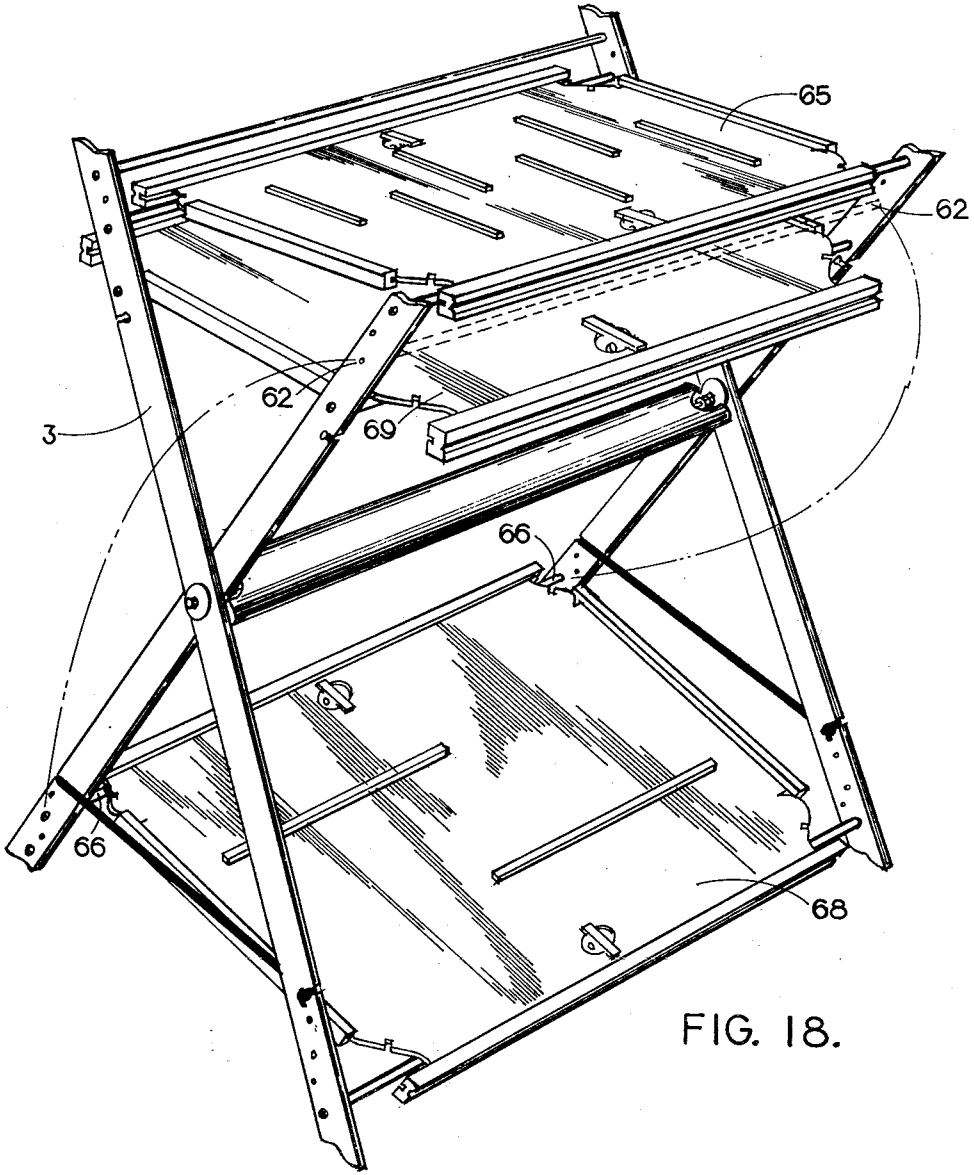

FIG. 18 is a projected perspective view illustrating the relocation of a rung, and additionally shows plural trays in plural slopes, and in combined slope and level arrangement.

Figure 19:
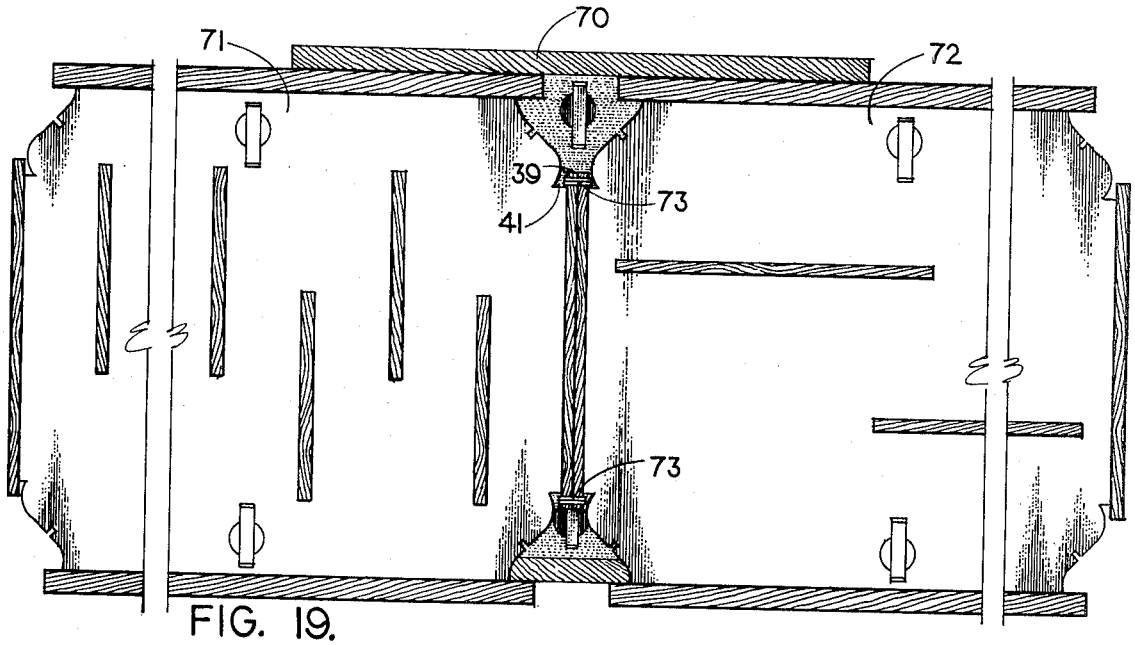

FIG. 19 is a top view illustrating plural trays joined side by side and means therefor.

Figure 20:
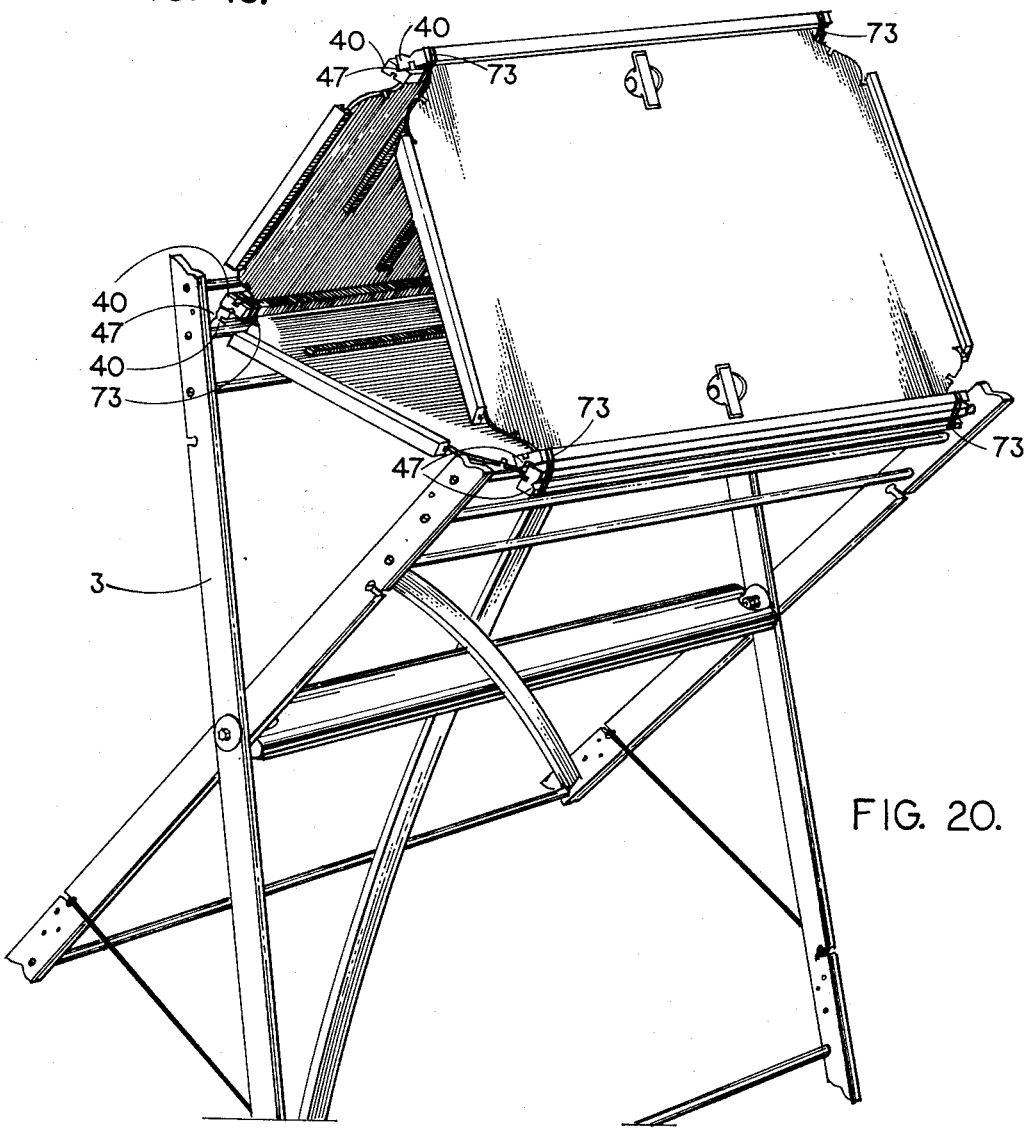

FIG. 20 is a perspective view of plural trays joined edge to edge, and into prismatic posture, and means therefor.

Figure 21:
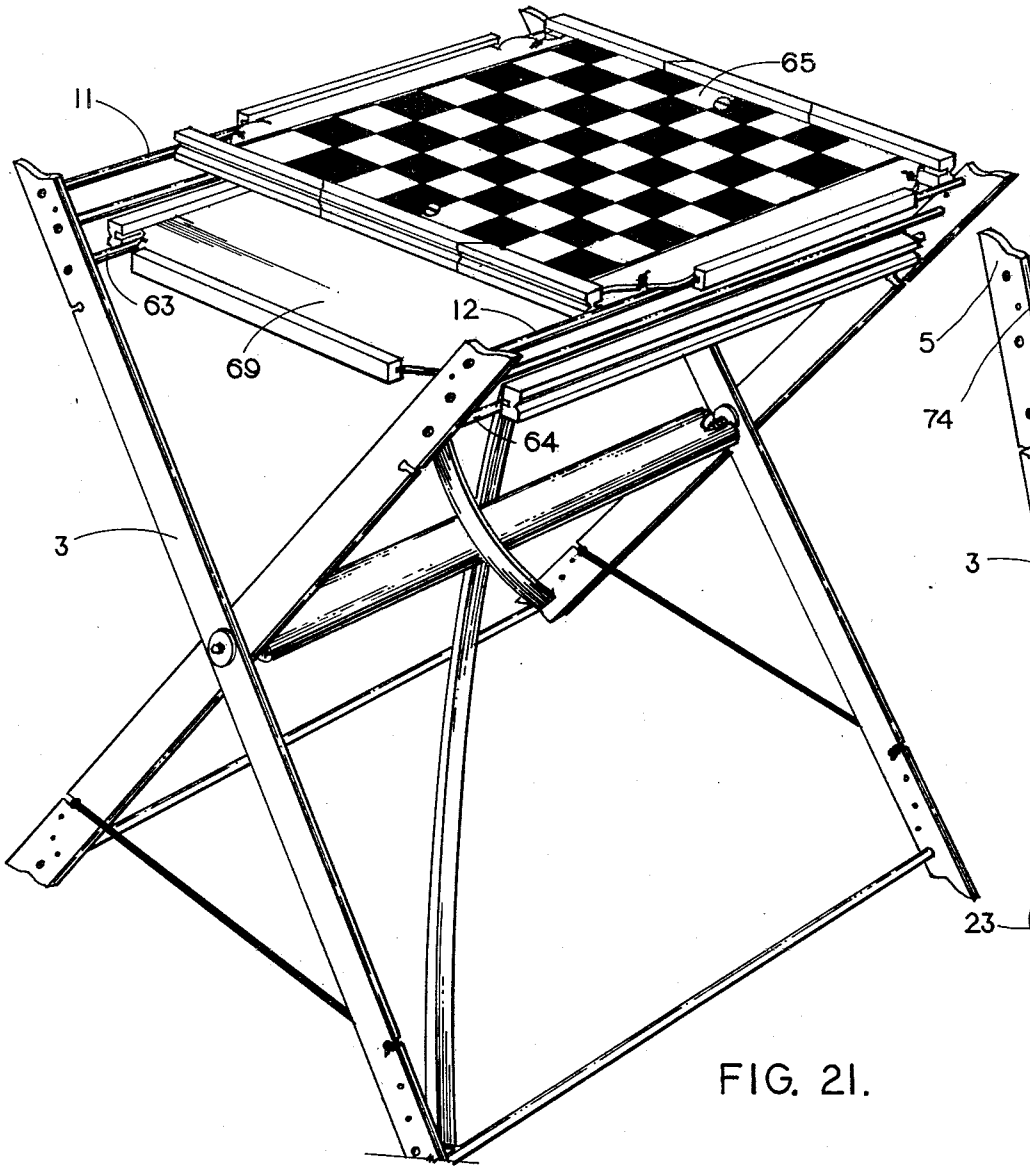

FIG. 21 is a perspective view illustrating plural trays cross-set and supported at plural levels on the stand.

Figure 22:
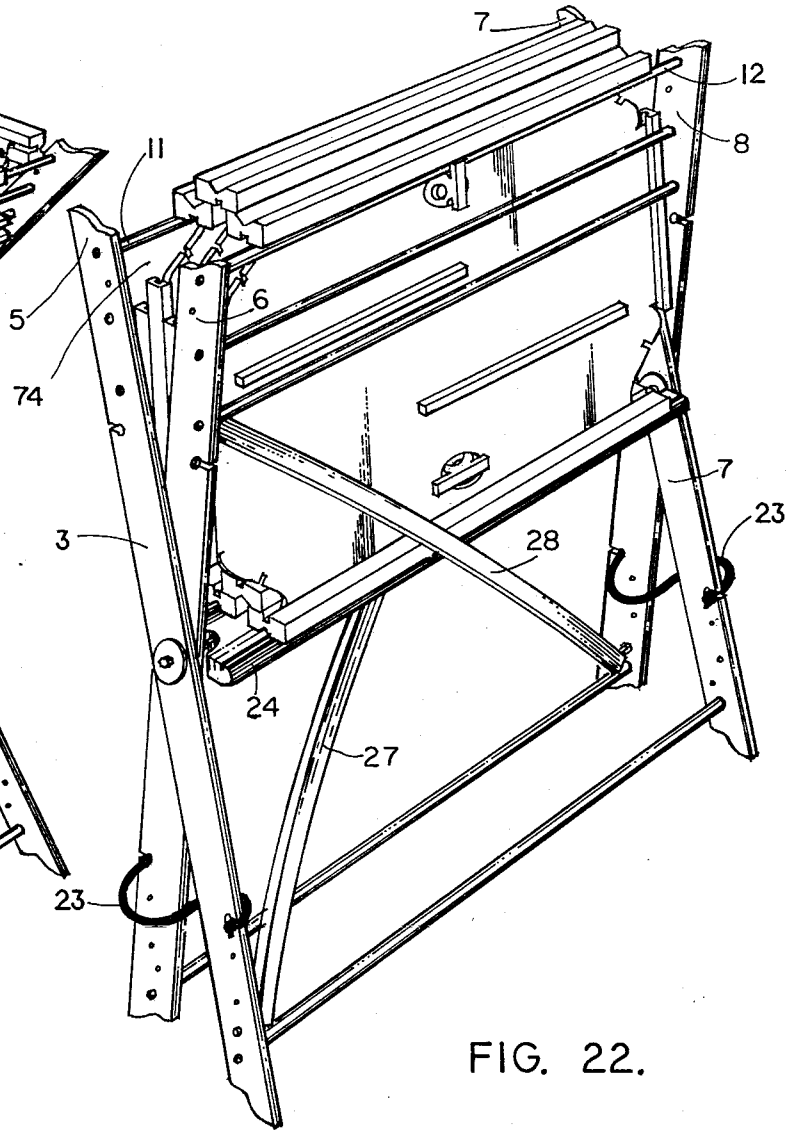

FIG. 22 is a perspective view illustrating tray(s) as stored inside a folded-up stand.

DESCRIPTION OF THE PREFERRED EMBODIMENT

GLOSSARY—hereinafter, as used in this description: "stand" refers to a foldable, cross-legged stand; "slip-grip foot" refers to the configuration at each end of each stand leg;

"tray" refers to an invertible, portable table top normally having reinforced outer bounds and a lock system;

"tray-bed" refers to a portion of thin, normally rectangular, surface material used for a tray surface;

"sides of a tray" means shorter bounds of a tray;

"edges of a tray" means longer bounds of a tray;

"handle" refers to an invertible, reinforcing strip attached along a side of a tray;

"rail" refers to an invertible, continuous, reinforcing strip attached along an edge of a tray;

"stub-rails" refer to identical end sections of a rail, which rail has been divided into three sections;

"mid-rail" refers to the central section of a divided rail;

"open corner" means that rail and handle fail to reach and meet at the configured corner of a tray-bed;

"hangbutton" refers to a manually rotatable lock, vertically symmetrical and invertibly displaceable through a tray-bed;

"rein" refers to elastic material used to allow, yet restrain, lateral spread of stand legs;

"band" refers to elastic material used to stretch across a tray for some described purpose;

"rubber band" refers to a common rubber band, about #16 size;

"dividers" refer to linear obstructions attached to, and jutting up from, a tray-bed; and "stagger-stack" means to collect trays, or tray halves, such that tray-beds are parallel, respective rails are adjacent in zigzag order, and respective handles are flush.

Figures 1, 2, 3:
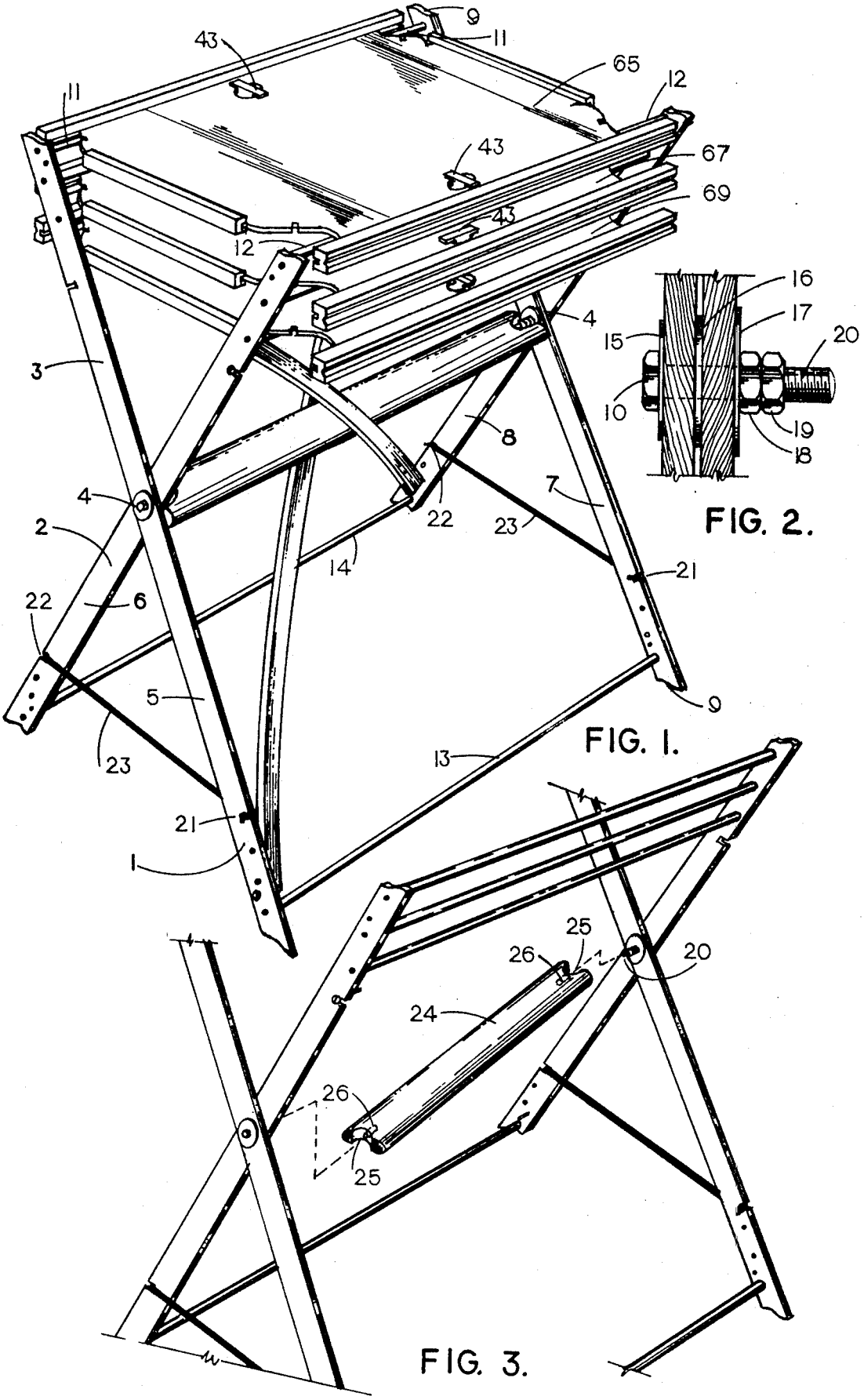
FIG. 1 is a perspective view of an open, foldable table illustrating stand parts and assembly, foot design, reins, footrest, braces, portable tray(s), and support of same.
FIG. 2 shows the pivot assembly for the stand.
FIG. 3 is a fragmentary projected view illustrating the means for removably attaching a footrest.

In the drawings, FIG. 1 shows a foldable, cross-legged stand supporting portable tray(s) on rungs; FIG. 2 shows the details of pivot assembly; FIG. 4 exposes the rungs of FIG. 1.

In FIGS. 1 and 4, stand 3 is assembled from identical rectangular frames 1 and 2, which frames comprise two slatted hardwood legs each, 5,7 and 6,8, interconnected by transverse support rungs, the hardwood dowels 11,12 top and 13,14 bottom. Both rungs and legs are designed to be reversible, and made to be interchangeable to any related position on a stand.

In FIG. 4, two legs, as 5,6, are joined to pivot at the midpoints 4—see also FIG. 6—to form a leg set, and two such leg sets, 5,6 and 7,8, are interconnected near top and bottom by top rungs 11,12 and bottom rungs 13,14 such that the two frames are crossed in link relationship in the stand, i.e., legs of the first frame are connected alternately outside and inside their mated counterparts of the second frame.

Each end of each leg has a slip-grip foot 9, FIG. 4 a reverse arc configuration yielding a toe-ball-arch-heel sole labeled respectively 25 as *9a-9b-9c-9d* in FIG. 6. Thus, the feet readily slip when the open stand is given any level push or pull, yet the soles tend to grip a surface under any applied vertical or near-vertical force.

Dimensionally, legs are $\frac{3}{8}''$ (9.53 mm) by $1\frac{1}{4}''$ (3.18 cm) by $29\frac{3}{4}''$ (75.57 cm) toe to toe; foot arc uses a 1" (2.54 cm) radius; rungs are 17-15/16" (45.56 cm) by $\frac{1}{2}''$ (1.27 cm) diameter; top and bottom rungs are attached by #8, $1\frac{1}{2}''$ (3.81 cm) metal screws through 5/32" (3.97 mm) holes centered at $\frac{3}{4}''$ (1.91 cm) from toe end, and $\frac{1}{2}''$ (1.27 cm) from heel edge, of the legs and into 9/64" (3.57 mm) centered rung holes.

FIG.2 pivot bolts 10 require outside washer 15, inside washer 17, tension nut 18, and locknut 19, whereby any desired binding tension can be pre-set. A thin polyethylene gall washer 16 is inserted between legs to minimize friction.

Dimensionally, pivot bolts are $\frac{1}{4}''$-20 (6.35 mm) by $1\frac{1}{2}''$ (3.81 cm) hex head cap screws; washers are of fender type, 18 gauge, O.D. 1" (2.54 cm) and $1\frac{1}{4}''$ (3.18 cm) by I.D. 9/32" (7.14 mm); gall washer is 0.020" (0.51 mm) by $1\frac{1}{8}''$ (2.86 cm) O.D. and $\frac{1}{4}''$ (6.35 mm) I.D; nuts are $\frac{1}{4}''$-20 (6.35 mm) hex head; about 5/16" (7.94 mm) of bolt protrudes beyond locknuts to form nubs 20 of FIGS. 2 and 3.

In the preferred enmbodiment, binding tension is merely snug and the stand is prevented from collapse by inserting elastic reins 23, FIG. 4, between legs of each leg set and through slot holes 21,22—see also FIG. 6—in the legs between pivot and bottom rung. Elastic reins are cords of multiple rubber strands encased in woven acetate, cut to given length, knotted at ends, the knots being fixed by a glue dip. This cord is the sturdy, 125% stretch material commonly sold for leather boot and legging laces. By using reins, the stand does not collapse and holds a set position by its own weight with or without tray(s). The stand is a useful bathroom rack for drying out hand washables, linen, and the like. Dimensionally, reins are cut 8" (20.32 cm) out of $\frac{1}{8}''$ (3.18 mm) diameter stock and knotted to leave a clearance of $6\frac{1}{2}''$ (16.51 cm); slotted leg holes 21,22 are 5/32" (3.97 mm) in diameter, centered $5\frac{7}{8}''$ (14.92 cm) from the toe and $\frac{1}{4}''$ (6.53 mm) inside the toe edge of the leg, the slots then cut 3/32" (2.38 mm) at right angles to the toe edge of the leg.

The stand as thus far described, i.e., comprising rungs, legs, and reins as in FIG. 10, is made into a useful snack bar or eating table by addition of a top tray since there is nothing under the tray to prevent pulling the table over the knees and above the lap when seated before the table. The fact that tables of this simplicity have a tendency to quiver somewhat is not objectionable for many light uses.

However, the quiver tendency is purposefully exploited by making the stand into a comfortable, swayable footrest. This is accomplished by inserting a removable footrest slab 24 of FIG. 3, which slab is made with a somewhat elliptical cross section. Pivot bolts are of such length, FIG. 2, as to provide protruding nubs 20 beyond locknuts 19. Each end of the footrest slab is dished at 25, FIG. 3, to fit around nuts 18,19, and midpoint sockets 26 are recessed to hold nubs 20. The footrest slab is quickly and easily inserted by placing one nub into one socket and forcing the stand pivot joints slightly apart, enough to allow the remaining footrest socket to swallow the remaining nub. Thus, the footrest slab is held by the stand tension until manually removed, and rotates easily to conform to a comfortable slope under the ankles. Rotation of the ankles slowly from side to side is enough to make the footrest sway. The footrest combination is purely optional as an accessory since it adds no structural strength to the table, nor does it detract from the same.

Dimensionally, the footrest slab is $17\frac{1}{2}''$ (44.45 cm) by $2\frac{3}{8}''$ (6.03 cm) by $\frac{5}{8}''$ (1.59 cm); end dish is centered with 9/16" (1.43 cm) radius; edges are rounded to about 5/16" (7.94 mm) radius; $\frac{1}{4}''$ (6.35 mm) sockets are centered to a depth of about $\frac{3}{8}''$ (9.53 mm) beyond the bottom of the dish.

The quiver tendency as described above is definitely objectionable where a steady surface is required as, e.g., where the use is for a working table, an instruction stand, an easel, a typing table, or the like. The foldable table as described thus far is made as firm as larger and heavier rigid tables by a quick reinforcement of the stand frames. This is accomplished by inserting removable braces, FIG. 4, 27,28, one diagonally across each frame. Ends of braces 29—see also FIG. 5—are cut square and slit narrow-wise a short way back, as at 30, FIG. 5, to fit over brace pins 31, FIG. 4. One end of a brace is inserted over a bottom brace pin and the frame contorted slightly to allow the opposing end to fit on. Braces are thus held in place by stand tension until manually removed and once both frames are braced and a tray mounted, the table is rigid, all ability to quiver having been eliminated.

In The FIG. 5 embodiment, hardwood braces are bowed such as to arc around and pass each other below the footrest slab area whether the slab is in or out. The resulting space inside the upper half of the stand leaves sufficient room for enclosing and storing multiple trays as described below, and as shown in FIG. 22. Hardwood braces respond in a conventional way to water or steam molding under pressure.

Dimensionally, the braces are ⅝" (1.59 cm) by ⅜" (9.53 mm) by 29⅛" (73.98 cm) overall before bowing, and 29" (73.66 cm) after bowing to an internal angle of 170°; brace pins are inserted through 5/32" (3.97 mm) holes in the legs; upper holes 32 for upper brace pins are upper slotted leg holes countersituate in the legs to the above described lower rein holes 21,22, lower holes 33 for lower brace pins are 1" (2.54 cm) directly in line and above the bottom rung holes 34—see also FIG. 6; slits 30 are cut midway of the ⅜" (9.53 mm) thickness of the brace ends 29 using ⅛" (3.18 mm) saw kerf to a depth of 1" (2.54 cm); pins are #6-32, 1" (2.54 cm) slotted head plastic bolts or ⅛" (3.18mm) stove bolts, which bolts are drawn tight by a single hex nut.

It is essential to the improved embodiment of this table that the handles and rails of the tray do not conjoin. FIGS. 7*a* to 7*d* illustrate four basic and functional open corners, viz., arc, FIG. 7*a*, bevel, FIG. 7*b*, criss-cross, FIG. 7*c*, and decorative FIG. 7*d*. Some decorative design is preferable as long as function is not sacrificed. FIG. 8 standard tray shows an open corner 35, functional in all respects, which employs a reverse arc of ¾" (1.91 cm) radius and adds the diagonal knotch 36 of 3/32" (2.38 mm) width at an inset depth of ⅜" (9.52 mm) and at 45° coming out of the tray-bed corner. Both handles 37 and rails 38 fall short of the overall tray-bed bounds yet both handles at 39 and rails at 40 protrude beyond the corner cut-outs. Handle ends create slots 41 with the open corner configuration. Open corners make it easy to dust or clean a tray but, chiefly, the open corners provide means for developing numerous convertible features discussed below.

Dimensionally, in FIG. 8, rails are 15⅜" (39.05 cm) by ⅝" (1.59 cm) by 1⅛" (2.86 cm); handles are⅜" (9.53 mm) by ⅝" (1.59 cm) by 8¾" (22.23 cm); raw tray-bed is 17⅛" (43.50 cm) by 13" (33.02 cm) by ⅛" (3.18 mm); both handles and rails use a rabbeted center channel ¼" (6.35 mm) by ⅛" (3.18 mm) for gluing onto the tray-bed to give an overall tray area of 17⅜" (44.13 cm) by 13¾" (34.93 cm); details on lock apertures 42 and hangbutton 43 are covered in this applicant's application #805,403, filed June 10, 1977 U.S. Pat. No. 4,138,952, and cross-referenced above in this application. As indicated by FIG. 9, the exposed face of each rail is fitted with a central arced groove 47 of ½" (1.27 cm) radius to about ⅝" (1.59 cm) width and ⅛" (3.18 mm) depth.

In FIG. 9, cord 44 is looped over protruding rail ends 40 for suspending a tray in picture-frame posture. Material inserted into the picture-frame tray as, e.g., the bulletin board, is fastened onto the tray by buttons 43 or by bands at 45 or at 46. Tray bands at 45 and 46 are identical to reins 23 of FIG. 1. FIG. 9 shows a bulletin board superfluously locked on by buttons, by bands horizontally, and by bands vertically. Any one method is enough. Using bands, the knotted ends are lodged in the knotches 36. Groove 47 along the exposed face of the top rail serves incidentally as a pencil or chalk groove.

Dimensionally, the bulletin board is 15⅝" (39.69 cm) by ⅜" (9.53 mm) by 11½" (29.21 cm) of reversible paper board; mid-edge and corner cut-outs are 1" (2.54 cm) radius.

The tray shown in FIG. 10 illustrates use of horizontal dividers 48 bonded to a tray-bed. The table shown in FIG. 10 is used as a reference material stand beside an office desk. Utilizing multiple top rungs, the tray of FIG. 10 allows a choice of eye level for reference materials whereas the stand allows the tray to perch at a choice of angles.

Dimensionally, horizontal dividers are 8¾" (22.23 cm) by ⅜" (9.53 mm) by ¼" (6.35 mm) and are glued to the tray-bed; spacing divides the surface into thirds.

FIG. 11 illustrates vertical dividers 49 bonded onto a solitaire tray 50 and selectively spaced for segregating cards or reference materials. Turning the solitaire board lengthwise makes an excellent reference tray for 3" (7.62 cm) by 5" (12.70 cm) index cards. For solitaire use, cards rest beside a divider, riding over an edge of the next divider for easy access in any of the seven columns. Aces are stored behind top band 45 and sloped to the rail. Open spaces such as 51 are used for card deck, discards, drinks, etc.

Dimensionally, vertical dividers are ⅜" (9.53 mm) by ¼" (6.35 mm) by 5¾" (14.61 cm) and glued to the tray-bed; spacing is about 2-3/64" (5.20 cm) from handles and between dividers which are vertically staggered alternately at 1⅞" (4.76 cm) and 4⅞" (12.38 cm) from each rail.

FIG. 12 illustrates a stowable tray 52 supportable on the stand yet at the same time collapsible for separate use, for storage, or for travel use as is suggested in FIG. 13. The collapsible tray is made from the standard tray-bed 50 of FIG. 11 by division of FIG. 11 parts. Inverted tray-bed 50 is cut into like halves 53, FIG. 12, using saw kerf of 3/16" (4.76 mm). The rabbedted faces of the standard rails are opposedly cut through at 45° at 4-13/16" (12.22 cm) from each end of the rail using a 1/16" (1.59 mm) kerf. The effect is to shorten the width of the original tray-bed and rails about 3/16" (4.76 mm) when the severed parts are realigned together. In assembly, the four FIG. 12 stub-rails 54 are glued whereas mid-rails 55 are unglued to be removable at will. The unit tray is held firmly together by stretching knotted bands 45 across the tray-bed between knotches 36, FIGS. 11 and 12.

Tray 52 of FIG. 12 is collapsed to FIG. 13 by placing on an even surface, band side down, and spreading halves enough to remove mid-rails 55, one at a time. Mid-rails are then laid just inside the seam edges of the servered tray-bed before the tray is folded over and stagger-stacked. FIG. 13 illustrates one firmly stored package. In that case, mid-rails 55 are removed, half-tray is folded toward half-tray, stub-rails over upon stub-rails, and mid-rails are stuck end to end along one of the seam edges of the tray halves between 45 band crossings. Upper stub-rails are then slid down off lower stub-rails whereupon the halves flatten out in stagger-stack position to clamp the mid-rails along the side. In no case is it necessary to remove bands before folding since they center into the saucers created at 56 from original lock apertures 42 of FIG. 11 when that tray-bed was split to make the tray halves 53 of FIG. 12. Final repose of the stored mid-rails at the seam edges distributes pressure from the crossing bands such as to create a toggled hinge effect, thus, the folded tray package remains closed of its own accord. A folded tray may be bound further by looping with an ordinary rubber band.

Dimensionally, level area of the folded tray is about 9" (22.86 cm) by 14⅜" (36.51 cm) as contrasted to the level area of about 17¼" (43.82 cm) by 13¾" (34.93 cm) for the locked-open tray; tray bands 45 are identical to reins 23 of FIG. 1.

FIGS. 14 and 15 illustrate other game designs compatible with the collapsible tray-bed area available on at least one surface of each tray. All games described are prepared for use upon whole tray-beds and provided with sufficient mid-line region to lose 3/16" (4.76 mm) upon splitting without thus altering game surface effectiveness. Whereas the game boards shown herein were prepared by hand, it is assumed that runs in quantity would be printed by the accepted practice of using a rubber plate on a rotary press.

Commercial aperture board having 1" (2.54 cm) centers is also used as a tray-bed material in the improved table and opens up many possibilities. See FIGS. 15, 16, 17, for examples. Commercial peg designs fit into the aperture board 57 when the FIG. 16 tray is hung or propped on a wall. An aperture board tray, such as shown in FIG. 16, makes a good play surface for toys and for making designs from strips, which toys and strips can be provided with plug-in pegs (not apparent). Chart 58 of FIG. 17 is designed for graphis instruction of youngsters in simple to complex principles of mathematics as illustrated The deeply imprinted lines and labels are inked in sharp color contrast to the background. Depending upon a child's ability, FIG. 17 visual chart plus the tactile points (orderly finger tip reference holes) are perceptually united to explore such concepts as: absolute value, addition, area, association, bases, center, circuit, columns, comparative value, coordinates, correspondence, counting, cumulation, dimension, distribution, division, equality, evens, exclusion, fractions, frequency, hundreds, inclusion, interval, line, midpoint, multiple, multiplication, negative value, number, number line, numerals, odds, opposites, perimeter, place value, point, quadrilateral, reverse, Roman numerals, rows, sequence, sets, squares, subtraction, tens, total, triangle, units, variable, zero, et al. An ingenious teacher will find other paths.

An excellent cribbage board is adapted to the aperture board surface by filling in additional scoring holes in the score area outlined in FIG. 15. Cribbage counters 59 store handily in the rail ends, or, in the case of a collapsible tray, they are ideally stored in shallow nests 60 scooped out of centers of mid-rails 55. The cribbage board is so situated as to be compatible with use of its inverse surface for other games or play surfaces such as 50 of FIG. 11. The aperture board itself is also compatible with use of handles, rails, locks, open corners, etc.

FIGS. 1, 10, 18, 20, and 21 indicate use of multiple top rungs on stands in order to accommodate multiple trays as shown.

Use of one, two, and three trays on a single stand offers permutation possibilities for combined levels, slopes, and mixtures thereof as well as possible use of the bottom rung area. As to bottom rung use, FIG. 18 illustrates that the fore middle top rung 62 has been removed and then relocated as 66 above the rear bottom rung, thus allowing opposed-angle slopes on the same stand. Such an arrangement makes an ideal luggage rack inasmuch as an upper top tray such as 65, having the vertical dividers for use as skids, accommodates luggage at a slight backward tilt for easy access, whereas, tray 68 at low level with forward slope accommodates shoes and such. Level tray 69 is convenient for papers and pocket items. A similar slope and level combination is referred to above, as a reference material stand.

Dimensionally, referring to FIG. 4, middle top rung holes for rungs 61 and 62 are located 2" (5.08 cm) below holes for upper top rungs 11 and 12, lower top rung holes for rungs 63 and 64 are located 2⅛" (5.40 cm) below middle top rung holes, all holes in the top rung region having identical counterparts located in the bottom rung region of legs, part of the reversible, interchangeable element plan. See FIG. 6.

All trays are so designed, and all rungs so located, as to permit multiple trays to repose in vertical sequence on stand 3. Trays 65, 67, and 69 of FIG. 1 are reposed respectively on the rung pairs 11-12, 61-62, and 63-64 of FIG. 4. When the rails of top tray 65 straddle rungs 11 and 12, the handles of bottom tray 69 extend and fit down between rungs 63 and 64. Middle tray 67 occupies a median position, i.e., tray 67 contacts rung 61 inside a rail and contacts rung 62 at a pair of handle ends, or vice versa. In any or all of these positions, trays are lockable on their rungs by use of the rotary hangbuttons 43 of FIG. 1. Thus, it is seen that spacing of the multiple rungs along the legs is deliberately designed to accommodate up to three trays at one time and setting whether the trays are locked, merely reposed, or in combination thereof, upon the stand. FIG. 1, then, is a starting point for utilizing multiple trays in a variety of combinations with the unit stand 3.

FIG. 19 shows two trays 71 and 72 attached side by side, indicating that any number of trays may be so attached. The two trays are connected by multiple looping ordinary rubber bands 73 around handle ends 39 and down inside slots 41 until firmly bound. Simplest assembly is to place one tray over the other, secure the handle ends, and then open the hinged trays. Rubber bands are those ordinarily found in desk drawers, e.g., size 16, which has a loop about 2½" (6.35 cm) long, cross section of about 1/16" (1.59 mm) and about 500% stretch.

An ideal typing stand is made by locking base tray 70, FIG. 19, upon a stand and centrally reposing banded trays 71 and 72 thereon as suggested by FIG. 19. Stability for typing requires using stand braces 27,28 in the manner described above and shown in FIG. 4. With typewriter centrally mounted, ample space extends left and right for reference and copy.

A number of trays are banded together edge to edge and FIG. 20 illustrates trays so attached to form a prism which is then locked across the stand for use as a music stand, easel, sketch board, and the like. Here again, interconnection is made with ordinary rubber bands 73, this time by multiple loops around protruding rail ends 40 until firm. Wherever the rails meet, a corner edge of one rail delves into the exposed groove 47 of its adjacent neighbor rail in this arrangement. Thus, the completed prism is stable, strong, and portable. On a stand, multiple rungs allow a range of slope for the front panel of the prism as can be inferred from FIG. 20.

An adjustable bedroom lapboard is made by using the prism of FIG. 20 independently of the stand. With one tray of the prism serving as a level base upon the lap in bed, rubber bands 73 at far corners of the base are freed up, i.e., the two or three binding loops are removed and only a single loop is used, whereupon the two trays inclining upward from the base hinge easily from their original 60° gable to any gabled position approaching horizontal. The resulting lapboard is light and comfortable, is stable at whatever position, and the face panel serves ideally for reading and writing in bed at any selected angle as well as serving for meal service on the surface at the full, near horizontal extension. The original prism is restored by tilting the face inward and letting the rubber bands pull the tray rails back together where the loosened corners are firmly rebound, i.e., looped two or three times as they were originally.

FIG. 21 shows that spacing of the rungs along the stand legs is such that when one tray 69 is placed upon the lower top rungs 63 and 64, and locked at the tray rails, the spacing of the upper top rungs 11 and 12 accommodates upper top tray 65 set lengthwise across the rungs, i.e., with the major axis of the upper tray at right angles to the major axis of the lower tray 69. This arrangement, as illustrated in FIG. 21, makes an ideal game table inasmuch as the game progresses at the upper level whereas drinks and such are disposable upon a level about 4" (10.16 cm) below, which lower level extends all the way under and also about 4" (10.16 cm) to the side of the upper level.

As to table elevation limits, using the preferred stand of FIG. 4, maximum table height is a work level at about 28" (71.12 cm) using a single tray locked at handle ends on the upper top rungs 11,12 whereas minimum table height is a play level of 16" (40.64 cm) using a single tray longwise on lower top rungs 63,64, all within the elastic range of reins 23.

Inasmuch as any tray can be fitted and fastened under, as well as over, rungs by using invertible hangbuttons 43, FIG. 1, there are stepwise in-between levels and slopes and combinations thereof through a gradient of about ⅜" (9.53 mm). Of a huge theoretical number of possible combination table settings, about 150 have been determined to be practical in some way.

Handles jut above and below the tray-bed ¼" (6.35 mm) wheras rails jut above and below ½" (12.70 mm) such that whenever one tray is stacked on top another, rail edge flush with rail edge, there is a ½" (12.70 mm) gap between handle edges, which gap disappears if the rails are stagger-stacked. This arrangement makes multiple trays easy to compact for small storage such that several trays may be stored within a folded-up stand. The preferred three trays depicted in FIG. 1 are now further shown in FIG. 22, stagger-stacked, and internally stored in the oblong bin 74 developed when stand 3 closes, which bin is then encompassed by upper legs 5,6 and 7,8 above footrest 24 and well inside braces 27,28. Ideally, each of two trays are hung by a rail and locked respectively to upper top rungs 11 and 12 whereas the third tray is stagger-stacked between outer trays. The folded stand, with or without trays, stands upright of its own accord. Any time the stand is folded, reins 23 tend to contract, sag, and store out of the way in the space between closing leg sets below the pivot region. Compacted with three stored trays, the stand remains closed of its own accord and stores upright in a floor area of 4" (10.16 cm) by 19" (48.26 cm). A stand, three trays, braces, and footrest slab will arrange to pack into a self-locking shipping case of internal size 19¾" (50.17 cm) by 2¾" (6.99 cm) by 30⅛" (76.52 cm).

Machining operations necessary to complete applicant's invention are those operations normally used in commercial cabinet shops. Metal parts are available from wholesale hardware sources. All raw materials are openly available from multiple sources at competitive prices. Hangbutton 43 of FIG. 1 is a specific element of U.S. Pat. No. 4,138,952.

This entire table system is purposely dimensioned such that imperfect or damaged elemental matter can be salvaged in successively smaller elements, as for example: tray-bed to half tray-bed; leg stock to brace to handle; footrest slab to rail; rail to handle or divided rail part; rail or handle to dividers; and longer dividers to shorter dividers. Shapes and dimensions are laid out to utilize commercial bulk shapes, sizes, and quantities at minimal waste.

Whereas applicant has described his novelty chiefly in terms of wooden materials, it is submitted that the elements may be derived as well from other matter-metal, plastic, etc. No attempt has been made to explore the myriad decorative hardboards which could provide much novelty and variety in tray-beds.

What is claimed is:

1. In a folding table combining an X-legged stand and supported planar surface(s), the improved combination comprising:

a. said stand wherein two identical oblong frames are opposedly inclined and assembled medially with pivot bolts into link formation, vertical members of said frames becoming legs of said stand, horizontal members of said frames being selectively located pairs of leg-attached rungs, one rung per pair per frame, a single pair of bottom rungs interconnecting said legs near the bottom of said stand, whereas three pairs of top rungs are respectively disposed near the top of said stand and interconnect said legs in three descending parallel and level planes;

b. selective elastic reins selectively located and attached above said lower rungs and between those legs of each X-leg set, for bridling planar spread of said stand; and c. one to three oblong portable trays, each of a uniform size and shape, each said tray being reversible and invertible, and hereinafter regarded as a standard tray which includes, (1) a standard tray-bed, flat, oblong, and having edges and sides selectively shortened by open contoured corners, and having lock apertures selectively located near said edges, (2) standard rails of selective length attached to said edges, which said rails jut above and below said tray-bed and into said open corners, (3) handles of selective length attached to said sides, which said handles jut above and below said tray-bed and into said open corners, and (4) hangbutton locks disposed through said lock apertures, and furthermore, said three trays being concurrently mountable and supportable on said three pairs of top rungs, retainable and lockable thereon in normal attitude, namely, major axis of any said tray parallel to its monopolized pair of rungs.

2. The table of claim 1 and further comprising a removably inserted, rotatable footrest, which said footrest fits over the nubs of said pivot bolts of said stand and is secured by stand tension.

3. The table of claim 1 and further comprising:

a. brace pins anchored to said legs inside diagonal corners of said frames; and b. a pair of removable braces, one said brace inserted diagonally across each said frame, which said braces cram onto said brace pins and are secured by stand tension.

4. The table of claim 1 and further comprising means for attaching any two of said three trays side-by-side, with said major axes in series, for creating an expanded surface and, whereas all said trays have handles which jut into open corners, said trays are abutted along companion handles whereat handle juts are removably bound together at both ends with elastic bands, and whereupon said expanded surface is mountable on said stand.

5. The table of claim 1 and further comprising means for attaching said three trays edge-to-edge, said major axes in parallel, for creating a prism structure and, whereas all said trays have rails which jut into open corners, a first said tray and a second said tray are abutted along companion rails whereat rail juts are removably bound together at both ends with elastic bands; further, a third said tray is thus bound to second said tray, whereupon the outer trays are hinged up to meet in prism attitude whereat the apex rails are further bound in stated manner for securing a right triangular prism, mountable on said stand as an easel and the like.

6. The table of claim 1 and further comprising means for mounting any two of said three trays, said major axes perpendicular, for creating tiered bilevel surfaces and, whereas said stand wears three pairs of top rungs in descending parallel and level planes, a first said tray is mounted on lower top rungs in said normal attitude, at which attitude the planar spread of upper top rungs spans the clearance between standard tray handles, whereupon second said tray is mountable on said upper top rungs and crosswise to the attitude of first said tray.

7. The table of claim 1 and further comprising compact self-storage means for said three trays, wherein a first and a second of said trays are inner-faced and respectively hung by a single rail of each onto the inside of upper top rungs of said stand, whereas a third said tray is stagger-stacked between said first and second trays as said stand is closed, whereupon all said trays are snugged into an oblong storage bin within said stand, said bin being encompassed by said legs above said pivots.

8. The table of claim 1 wherein one of said standard trays is modified for convenient travel use apart from said stand, said modified tray comprising:

a. two tray-bed sections from a transversely bisected standard tray-bed, which said sections are aligned at the seam;

b. two selectively trisected rails from standard rails, each yielding identical stub-rails and a wedgable mid-rail, which rail sections, in addition to handles, are fitted onto said tray-bed sections to form a standard tray contour, whereupon said handles and said stub-rails are glued in place;

c. means for keeping said modified tray seamed and stable wherein tension bands are stretched longitudinally across the seamed tray sections, one between lower corners and one between upper corners of said tray-bed, each end of each said band being anchored in knotches provided in said corners, whereupon said modified tray is usable in whatever manner of a standard tray; and d. means for collapsing said modified tray wherein, band side down, said mid-rails are manually removed, remaining said tray sections are hinged at the seam into a fold, stub-rail upon stub-rail, said mid-rails are tucked narrowly inside said fold, and the folded said tray sections are canted into stagger-stack attitude, whereat said modified tray is held stable by said bands and condensed in package condition for travel.

9. The table of claim 1 wherein one of said standard trays is modified for convenient travel use apart from said stand, and which said modified tray is prepared by a method comprising the steps of:

a. bisecting a standard tray-bed transversely into sections;

b. selectively trisecting two standard rails, each into rail sections comprised of identical stub-rail ends and a symmetrical and trapable mid-rail;

c. assembling said rail sections in addition to tray handles onto the seamed said tray-bed sections to form a unitary standard tray contour;

d. permanently attaching said stub-rail ends and said handles in place; and e. inserting bands longitudinally across said tray sections, one between lower corners and one between upper corners of said tray-bed, each end of each said band being anchored in knotches provided in said corners, which said bands maintain all seams tight and keep said tray sections in firm and stable attitude, whereupon said modified tray is usable in whatever manner of a standard tray, and wherein thereafter, said modified tray is collapsible by manual means into a stable condensed package for travel use.

10. The table of claim 1 wherein one of said standard trays is modified for use as a multi-sensory perception device for exploring mathematics, and which said modified tray is made by a method comprising the steps of:

a. selectively shaping a substituted tray-bed from hardboard having therein orderly rows and columns of small holes;

b. outlining a calculated graph upon the surface of said tray, whereon said holes are used for finger tip reference points, and which said graph includes, (1) lines selectively encompassing said rows and columns, which lines are used for tactile and visual guidance, and (2) labels disposed at selective sites on said tray-bed, which labels are used for vocal and visual identification and for associative interpretation of said points, said lines, and combinations thereof, and c. imprinting said lines and said labels in color contrast to the background of said surface for profiling said graph on said surface.

11. The table of claim 1 wherein one of said invertible standard trays is modified for use as a combination play-tray and multi-sensory perception device for exploring mathematics, said modified tray combination comprising:

a. a substituted tray-bed selectively shaped from hardboard having therein orderly rows and columns of small holes;

b. selectively designed building strips and toy pieces removably attached to a surface of said tray-bed for creative play use;

c. a calculated graph outlined on the inverse surface of said tray-bed, whereon said holes are used for finger tip reference points, said graph including, (1) lines selectively encompassing said rows and columns, which lines are used for tactile and visual guidance, and (2) labels disposed at selective sites on said tray-bed, which labels are used for vocal and visual identification and for associative interpretation of said points, said lines, and combinations thereof; and d. means for profiling said graph on said inverse surface wherein said lines and labels are imprinted in color contrast to the background of said inverse surface.

* * * * *